US006928665B1

(12) United States Patent
Yates

(10) Patent No.: US 6,928,665 B1
(45) Date of Patent: Aug. 16, 2005

(54) CYCLE PANTS WITH BREATHABLE SADDLE CUSHION

(76) Inventor: Paul M. Yates, 5814 Briar Tree, La Canada, CA (US) 91011

( * ) Notice: Subject to any disclaimer, the term of this patent is extended or adjusted under 35 U.S.C. 154(b) by 0 days.

(21) Appl. No.: 10/821,535

(22) Filed: Apr. 8, 2004

(51) Int. Cl.[7] ..... A41D 13/00
(52) U.S. Cl. ..... 2/466; 2/455
(58) Field of Search ..... 2/455, 466, 69, 2/227, 228, 238, 214, 267; 450/98; 297/214, 297/200, 219.11, 452.41

(56) References Cited

U.S. PATENT DOCUMENTS 4,805,243 A 2/1989 Gibbens et al.
4,894,867 A 1/1990 Ceravolo et al.
4,945,571 A 8/1990 Calvert
4,961,233 A 10/1990 Black
5,068,920 A 12/1991 Bray
5,271,101 A 12/1993 Speth et al.
5,978,970 A * 11/1999 Bright ..... 2/267
6,393,618 B2 5/2002 Garneau
6,547,327 B1 * 4/2003 Yates ..... 297/214
6,687,917 B2 * 2/2004 Forsyth et al. ..... 2/228

* cited by examiner

*Primary Examiner*—Gloria M. Hale
(74) *Attorney, Agent, or Firm*—Walter A. Hackler

(57) ABSTRACT

Cycle pants include a body portion having a waist opening, a crotch portion and a seat portion along with a breathable cushion attached to an inside surface of the body portion which includes a perineal portion covering the crotch portion and the buttocks portion covering the seat portion. The buttocks portion has a width greater than the perineal portion and includes two spaced apart lobes for providing flexible anatomical support.

13 Claims, 3 Drawing Sheets

CYCLE PANTS WITH BREATHABLE SADDLE CUSHION

The present invention is generally related to a chamois for use with the cycle pants and is more particularly directed to a breathable chamois, or cushion, for providing support and ventilation for cycle pants.

Cycle pants/shorts of various designs are popular in that they provide durability and cushioning between the bicycle seat and the cyclist. Accordingly, they minimize chaffing of the cyclist and further absorb shock.

Heretofore, chamois, or cushions, have been made through the use of multilayered fabrics and foams and including a liquid filled chamois, such as, set forth in U.S. Pat. No. 4,945,571, which includes overlying layers to facilitate perspiration and leakage.

The present invention provides for cycle pants, incorporating including a breathable cushion, such as set forth in U.S. Pat. No. 6,547,327 to Yates. This structure enables ventilation to the cyclist while at the same time absorbing high impacts.

SUMMARY OF THE INVENTION

Cycle pants in accordance with the present invention generally include a body portion having a waist opening, a crotch portion and a seat portion. A breathable cushion is attached to an inside surface of the body portion and includes a perineal portion covering the crotch portion and a buttocks portion covering a seat portion.

The buttocks portion is wider than the perineal portion and includes two spaced apart lobes for providing anatomical support.

More particularly, the breathable cushion includes a base sheet having a periphery and a matrix of openings therethrough with a cover sheet having a matrix of openings aligned with the matrix of base sheet openings and sealed to the based sheet along the base sheet periphery.

A gel is disposed between the base and the cover sheet with the gel being continuous between the base sheet and the cover sheet openings. The cover sheet is sealed to the base sheet around each of the base sheet openings to form a matrix of pockets with each pockets surrounding a base sheet and cover sheet opening.

Alignment of the pockets provides a means for facilitating bending of the cushion in order to conform the cushion to a curvilinear surface which includes a bicycle seat and the cyclists' buttocks.

The pockets may be circular, square or rectangular. Alignment of the pockets includes alignment of diagonals of each of the pockets.

BRIEF DESCRIPTION OF THE DRAWINGS

The present invention will be better understood with reference to the following detailed description in conjunction with the appended drawings of which.

DETAILED DESCRIPTION

Figure 1:
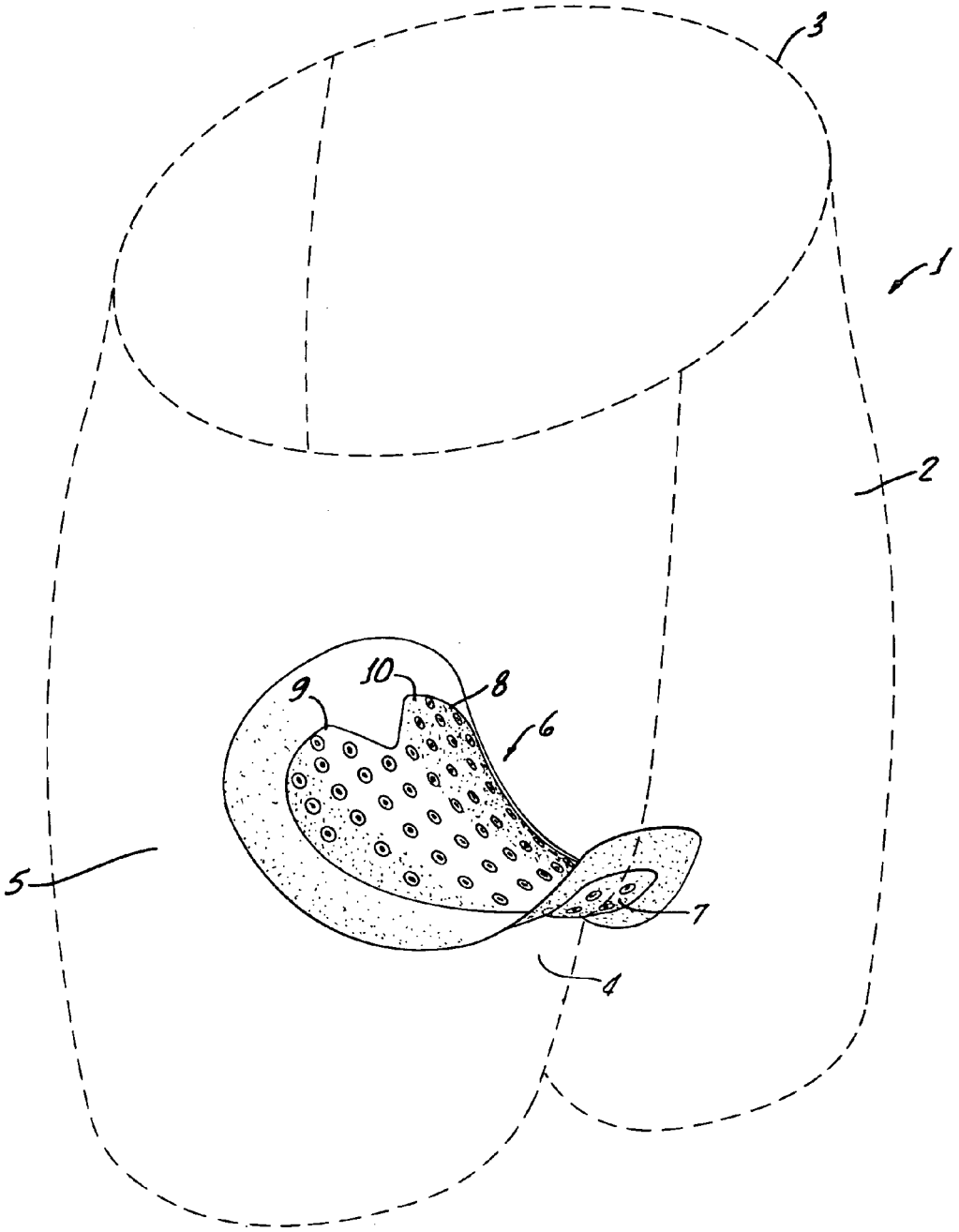
FIG. 1 is a perspective view of cycle pants in accordance with the present invention showing a body portion having a waist opening, a crotch portion and a seat portion along with a breathable cushion attached to an inside surface of the body portion.

With reference to FIG. 1, there is shown cycle pants 1 in accordance with the present invention generally including a body portion 2 having a waist opening 3, a crotch portion 4, and a seat 5.

A breathable cushion 6 is attached to an inside surface of the body 2 in any conventional manner and includes a perineal portion 7 covering the crotch portion 4 and a buttocks portion 8 covering the seat portion 5.

The buttocks portion 8 is wider than the perineal portion 7 and includes spaced apart lobes 9, 10, which provide independent anatomical support of a cyclist's buttocks (not shown). That is, because the lobe portions may flex independent of one another and they provide more efficient cushioning and support for the cyclists' buttocks.

Preferably, the pants body 2 is fabricated from a suitable breathable material as is well known in the art for cycle clothing.

Figure 2:
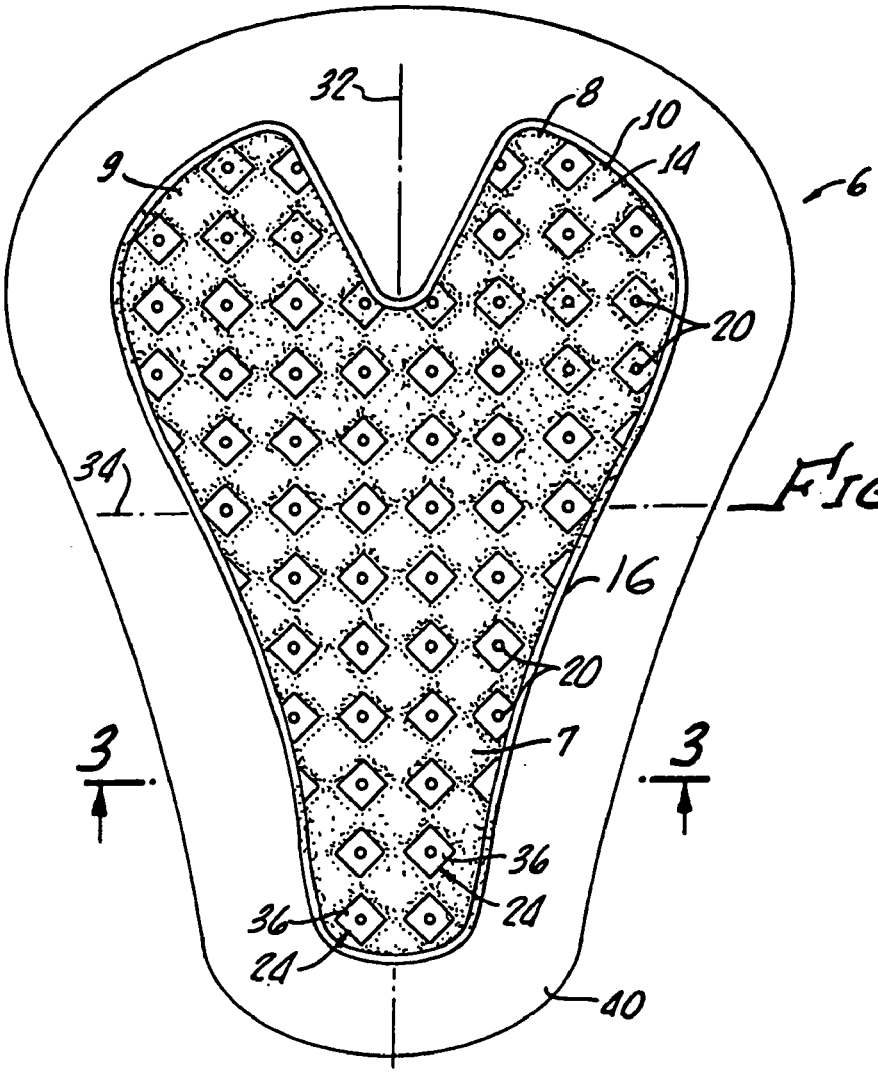
FIG. 2 is a plan view of the cushion shown in FIG. 1 illustrating one embodiment of the present invention showing square shaped pockets and pocket alignment in order to provide cushion flexibility.

With reference to FIG. 2, there is shown the breathable cushion 6 in accordance with the present invention which generally includes a base sheet 12 and a cover sheet 14 each sharing a common periphery 16 and sealed together along the periphery 16.

Each of the base sheet 12 and cover sheet 14 include a matrix openings 20 therethrough for enabling venting through the cushion. The cover sheet 14 is also sealed to the base sheet around each of the openings 20 to provide a matrix of pockets 24. Resiliency of the cushion 6 is provided by a gel 28 disposed between the base sheet 12 and cover sheet 14. The gel 28 is continuous between the base sheet 12 and cover sheet 14 except across the openings 20. This enables uniform resiliency of the cushion 6.

Figure 3:
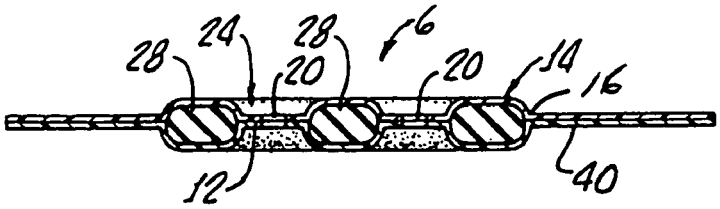
FIG. 3 is a cross-sectional view taken along the line 3—3 of FIG. 2 more clearly showing the base sheet, cover sheet and gel disposed therebetween along with pockets in line with openings through the cover sheet and the base sheet.

FIG. 3 is a cross-sectional view of the cushion 6 more clearly illustrating the openings 20 which provide for ventilation of the cushion 6 and pants 1.

It should be appreciated that the term gel is used herein means any gel-like material having the resilient qualities of gel whether or not the gel-like material is considered by way of chemical or physical description to be a true gel. Suitable gels that are used in the present invention are set forth in the U.S. Pat. No. 6,027,674 to Yates and is to be incorporated herewith in its entirety by the specific reference thereto for teaching suitable gels.

Each of the pockets 24 having a generally rectangular cross-section, preferably a square cross-section. It has been found that this configuration inhibits sealing of the pockets, thus enabling proper ventilation of large body areas when in contact with the cushion 6.

As shown in FIGS. 1 and 2, the matrix of the openings 20 is also rectilinear.

The cushion 6 shown in FIGS. 1 and 2, may have an elongate shape with a longitudinal axis 32 and a transverse axis 34. As best shown in FIG. 2, diagonals 36 of the pockets 24 are parallel with the longitudinal axis 32 with normal diagonals 38 being parallel with the transverse axis 34. This structure facilitates the flexibility and conformability of the cushion with a rectilinear surface such as that of a formed bicycle saddle, not shown.

In that regard, as shown, each pocket 24 has a width measured along the pocket diagonal 36 which is greater than a distance between adjacent pockets 24 measured along the pocket diagonal. This structure is utilized to alter the resiliency of the cushion and also tailor the flexibility or conformability of the cushion 6 curved surface, not shown.

Fabrication of the cushion 6 may be made in accordance with U.S. Pat. Nos. 5,679,193, 5,756,184, 5,932,046, 5,993,584, 6,017,407, 6,048,602, 6,050,964, 6,082,683 and 6,117,259 to Yates. All of these patents are to be incorporated herewith by the specific reference thereto including all specifications and drawings for the purpose of teaching a method for manufacturing of the present invention.

A skirt 40 of base sheet 12 and/or cover sheet 14 may be provided for securing the cushion 6 to the pants body 2, as hereinbefore noted.

Figure 4:
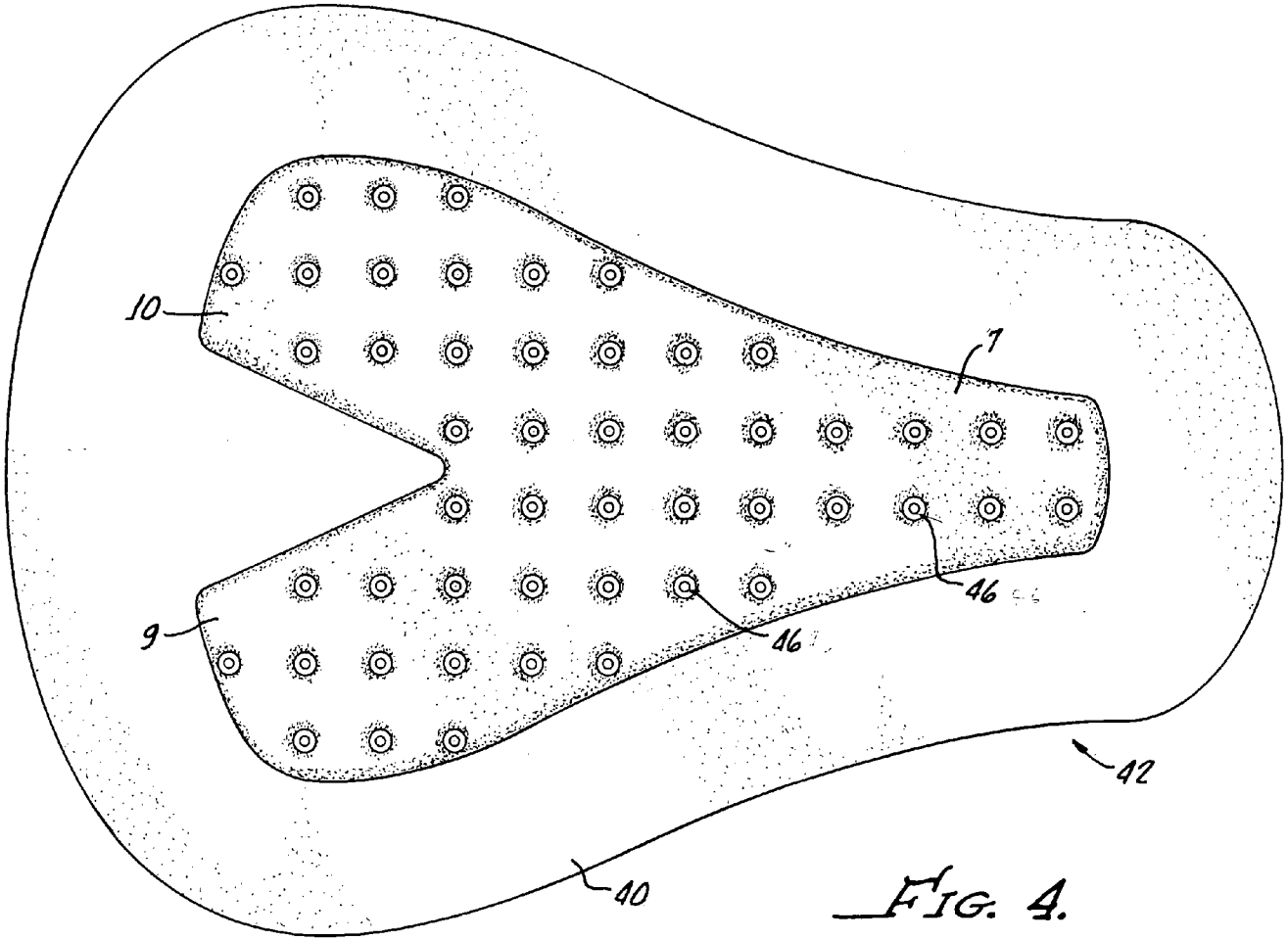
FIG. 4 is an alternative embodiment of the present invention in which the cross-sections of the pockets are circular.

With reference to FIG. 4, there is shown an alternative embodiment of cushion 42 similar to the embodiment 6 with common character references indicating identical or substantially similar elements. In the cushion 42, the pockets 46 have a circular cross-section and are aligned in a rectilinear pattern in order to provide flexibility to the cushion 42 as hereinabove discussed in connection with the embodiment cushion 6.

Although there has been hereinabove described a specific cycle pants with breathable saddle cushion in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. Cycle pants comprising:

a body portion having a waist opening, a crotch portion and a seat portion;

a breathable cushion attached to an inside surface of said body portion and having a perineal portion covering said crotch portion and a buttocks portion covering said seat portion, said buttocks portion being wider than said perineal portion and including two spaced apart lobes, and wherein said breathable cushion comprises:

a base sheet having a periphery and a matrix of openings therethrough:

a cover sheet having a matrix of openings aligned with a matrix of base sheet openings and sealed to said base sheet along the base sheet periphery; and a gel disposed between the base and cover sheets, said gel being continuous between the base sheet and cover sheet openings, said cover sheet being sealed to said base sheet around each of the base sheet openings to form a matrix of pockets, each pocket surrounding a base sheet and cover sheet opening; and means for facilitating bending of the cushion in order to conform the cushion to a curvilinear surface, said means including alignment of the pockets with one another.

2. The cycle pants according to claim 1 wherein the means for facilitating bending of the cushion comprises rectilinear alignment of said pockets.

3. The cycle pants according to claim 2 wherein each pocket has a circular perimeter.

4. The cycle pants according to claim 1 wherein said breathable cushion comprises:

a base sheet having a periphery and a matrix of openings therethrough;

a cover sheet having a rectilinear matrix of openings aligned with the matrix of base sheet openings and sealed to said base sheet along the base sheet periphery; and a gel disposed between the base and cover sheets, said gel being continuous between the base sheet and cover sheet openings, said cover sheet being sealed to said base sheet around each of the base sheet openings to form a matrix of pockets, each pocket surrounding a base sheet and cover sheet opening and having a generally square cross-section; and means for facilitating bending of the cushion in order to conform the cushion to a curvilinear surface, said means including alignment of diagonals of each of the square cross-sectional pockets aligned with one another.

5. The cushion according to claim 4 wherein each pocket has a width, measured along the pocket diagonal, greater than a distance between adjacent pockets measured along pocket diagonals in order to alter cushion resiliency.

6. Cycle shorts comprising:

a body portion having a waist opening, a crotch portion and a seat portion; and a breathable cushion attached to an inside surface of said body portion and having a perineal portion covering said crotch portion and a buttocks portion covering said seat portion, said buttocks portion being wider than said perineal portion, said breathable cushion comprising:

a base sheet having a periphery and a matrix of openings therethrough;

a cover sheet having a matrix of openings aligned with the matrix of base sheet openings and sealed to said base sheet along the base sheet periphery;

a gel disposed between the base and cover sheets, said gel being continuous between the base sheet and cover sheet openings, said cover sheet being sealed to said base sheet around each of the base sheet openings to form a matrix of pockets, each pocket surrounding a base sheet and cover sheet openings; and means for facilitating bending of the cushion in order to conform the cushion to a curvilinear surface, said means including alignment of pockets with one another.

7. The cycle shorts according to claim 6 wherein the means for facilitating bending of the cushion comprises rectilinear alignment of said pockets.

8. The cycle shorts according to claim 7 wherein each pocket has a circular perimeter.

9. The cycle shorts according to claim 6 wherein said buttocks portion comprises two spaced apart lobes.

10. Cycle shorts comprising:

a body portion having a waist opening, a crotch portion and a seat portion; and a breathable cushion attached to an inside surface of said body portion and having a buttocks portion covering said seat portion, said breathable cushion comprising:

a base sheet having a periphery and a matrix of openings therethrough;

a cover sheet having a matrix of openings aligned with the matrix of base sheet openings and sealed to said base sheet along the base sheet periphery;

a gel disposed between the base and cover sheets, said gel being continuous between the base sheet and cover sheet openings, said cover sheet being sealed to said base sheet around each of the base sheet openings to form a matrix of pockets, each pocket surrounding a base sheet and cover sheet openings;

means for facilitating bending of the cushion in order to conform the cushion to a curvilinear surface, said means including alignment of pockets with one another.

11. The cycle shorts according to claim 10 wherein the means for facilitating bending of the cushion comprises rectilinear alignment of said pockets.

12. The cycle shorts according to claim 11 wherein each pocket has a circular perimeter.

13. The cycle shorts according to claim 10 wherein said buttocks portion comprises two spaced apart lobes.

* * * * *